United States Patent [19]

Okesaku et al.

[11] Patent Number: 4,987,930

[45] Date of Patent: Jan. 29, 1991

[54] AUXILIARY SUB-NOZZLE FOR FLUID JET LOOM

[75] Inventors: Masahiro Okesaku, 133-1, Ha, Minamiasai-machi, Komatsu-shi Ishikawa, 923; Michito Miyahara; Ryosuke Ataka, both of Fukuoka; Tooru Nakagawa, Komatsu, all of Japan

[73] Assignees: Nippon Tungsten Co.; Ltd. Tsudakoma Corp., both of Fukuoka; Masahiro Okesaku, Ishikawa, all of Japan

[21] Appl. No.: 381,709

[22] PCT Filed: Oct. 6, 1988

[86] PCT No.: PCT/JP88/01023

§ 371 Date: Jul. 5, 1989

§ 102(e) Date: Jul. 5, 1989

[87] PCT Pub. No.: WO89/04390

PCT Pub. Date: May 18, 1989

[30] Foreign Application Priority Data

Nov. 11, 1987 [JP] Japan ..... 62-284468

[51] Int. Cl.[5] ..... D03D 47/30

[52] U.S. Cl. ..... 139/435.5; 239/DIG. 19; 501/102; 226/97

[58] Field of Search ..... 501/102; 138/146; 51/439; 239/DIG. 19, 424, 430; 139/435.4, 435.5; 428/131; 226/97; 226/97

[56] References Cited

U.S. PATENT DOCUMENTS

| | | | |
|---|---|---|---|
| 3,875,971 | 4/1975 | Hamling | 138/146 |
| 3,923,587 | 12/1975 | Porte | 28/240 |
| 3,988,084 | 10/1976 | Esposito et al. | 239/424 X |
| 4,081,000 | 3/1978 | Wollenmann | 139/435 |
| 4,478,368 | 10/1984 | Yie | 239/430 |
| 4,636,481 | 1/1987 | Kida et al. | 501/102 |
| 4,822,662 | 4/1989 | Ishii et al. | 428/131 |

*Primary Examiner*—Andrew M. Falik

*Attorney, Agent, or Firm*—Jordan & Hamburg

[57] ABSTRACT

An auxiliary nozzle for a loom, such as an air jet loom within a shuttleless loom, jets pressurized gas in order to prevent stall of weft inserted into warp shedding. At least a tip portion of an auxiliary nozzle body is formed of ceramics material having a very small integrally-molded surface roughness of 0.5 μm or less and having characteristics of high toughness and high strength whereby occurrence of flaws in warp can be minimized and woven fabric of high quality can be obtained. Particularly, by employment of particular zirconia-type ceramics, the moldability, processing properties for drilling and wear resistance can be improved.

16 Claims, 2 Drawing Sheets

AUXILIARY SUB-NOZZLE FOR FLUID JET LOOM

FIELD OF ART

The present invention relates to an auxiliary sub-nozzle for looms, e.g., an air jet loom within a shuttleless loom, which jets a pressurized gas in order to prevent stall of a weft inserted into warp shedding, and a method for manufacturing such a sub-nozzle.

BACKGROUND OF THE INVENTION

Conventionally, an auxialiary nozzle for a loom is formed into a hollow-rod-like member by a press drawing process or by seamless welding of a metal sheet, as disclosed in Japanes Unexamined Patent Publication (Kokai) Nos. 54042/1983, 106541/1934 and the like. The following conditions should be fulfilled in terms of functional or positional restriction thereof.

First, in weft insertion, a tip portion of an auxiliary nozzle has to be moved into a warp shedding and moved backward from the warp shedding before beating up takes place. At this time, the tip portion of the auxiliary nozzle is moved into the warp shedding while forcing itself through the sheet-like warps, and therefore the outer peripheral surface thereof rubs against the warp. Therefore, a sectional width of the auxiliary nozzle has to be made as small as possible in order to avoid friction with the warp, to minimize an increase of friction and tension of the warp and to not impede jetting of air from the auxiliary nozzle for carrying weft.

The auxiliary nozzle, in a state wherein internal air stays therein, jets air for carrying weft from a small jet orifice at a predetermined flow velocity. Therefore, the larger the internal area near the jet orifice, the higher the speed of jet flow, and therefore the volume thereof should be made as large as possible. On the other hand, the length (depth) of the jet orifice need have a dimension in excess of a predetermined value in comparison to the diameter of the jet orifice in order to stabilize and straighten the direction of the jet flow. Such a theoretical elucidation is disclosed in, for example, Japanese Patent Publication (Kokoku) No. 32733/1985.

As described above, the auxiliary nozzle of this kind need be fulfilled with the reciprocal requirement in which the dimension of the outside diameter is made as small as possible and the internal volume made large, but a metal nozzle manufactured by the above-described processing method is limited in fulfilling this requirements.

Since the tip portion of the auxiliary nozzle is moved into and backward from the warp shedding while rubbing against the warp, the outer peripheral portion of the auxiliary nozzle becomes worn, and surface flaws, cracks, burrs or the like occur. If these become large, the warp becomes damaged, cut or fluffed, deteriorating the quality of the woven fabric. Therefore, the surface thereof should have an excellent wear resistance.

Japanese Unexamined Utility Model Publication (Kokai) No. 28887/1987 discloses a nozzle body which is formed of a cermet material excellent in toughness in order to improve the wear resistance of the surface. However, the inner wall surface of the jet orifice should be as smooth as possible to converge and straighten the jet flow. The roughness of the surface need be 0.5 μm or less. In the normal cermet material, grains thereof are large and the cermet comprises a composition of hard grains and a metal binder. Therefore, as wear progresses, the hard grains project, as a result of which the surface and inner wall surface become rough, failing to fulfill the necessary condition of surface roughness.

Furthermore, it has an insufficient wear resistance, and it is difficult to mold a pipe-like configuration on which one end is closed. It is also very difficult to mold so as to have a one-sided wall thickness, failing to obtain a thin auxiliary nozzle.

Moreover, it is contained contemplated that a ceramics layer is formed by flame coating processing in order to improve the wear resistance, which however involves the problem of drilling a jet orifice. That is, a jet orifice for jetting air must be provided at the fore end portion of the auxiliary nozzle, but when the ceramic is subjected to flame coating processing after a jet orifice has been made in the nozzle body, an uneven layer of the ceramics layer occurs on the inner surface of the jet orifice because it is difficult to apply even flame coating to the inner peripheral surface of the jet orifice. If the inner surface of the jet orifice is uneven, the jet flow becomes unstabilized and in addition the flame coated layer on the surface of the nozzle body can possibly peel off, thus failing to provide a sufficient function as an auxiliary nozzle.

Moreover, in the manufacture of auxiliary nozzles, drilling processing is also important, which processes include electric discharge machining, diamond drilling, laser processing, supersonic vibration machining, etc. Among these processes, as a process for making a jet orifice of an auxiliary nozzle, electric discharge machining is most effective since burring of an open surface of a jet orifice and chamfering after the process need not be employed, finishing is good in terms of jet characteristics of the fluid, drilling with high accuracy becomes possible, and the drilling process is inexpensive as well as making volume production possible. As described above, it is desirable to employ a conductive material for manufacturing an auxiliary nozzle.

The auxiliary nozzle according to the present invention can be utilized for a sub-nozzle for an air jet loom within a shuttleless loom, and the method for the manufacture thereof can be utilized for manufacturing a nozzle member made of ceramics of the same kind.

SUMMARY OF THE INVENTION

It is therefore an object an object of the present invention to provide an auxiliary nozzle and a method for manufacturing the same, in which an auxiliary nozzle can be formed to be thin, as well as of a one-sided wall thickness, has a wear resistance, has a small surface roughness, and totally fulfills all requirements for auxiliary nozzles for looms, such as workability of the jet orifice.

An auxiliary nozzle having at least a fore end thereof with a surface roughness of 0.5 μm or less is formed of integrally molded ceramics material having high toughness and high strength to thereby achieve the aforementioned object.

It is desirable that the above-described ceramics material have a relative density of 98% or more, a hardness in $H_RA$ of 89 or more, a bending strength of 50 $kg/mm^2$ or more, a modulus of elasticity of $1.4\times10^4$ $kg/mm^2$ or more and a homogeneous structure. Further, in terms of coefficient of friction of hardness, that is, slidability, zirconia or a composite material using zirconia as a matrix is most excellent, preferably having a relative density of 99% or more, a hardness in $H_RA$ of 89.5 or more, a bending strength of 70 kg/mm$^2$ or more and a modulus of elasticity of $1.8\times10^4$ kg/mm$^2$ or more.

As the zirconia material, chemically stable zirconia is suitable. Particularly, as the stabilizer, yttrium oxide, calcium oxide, magnesium oxide, cerium oxide or the like is added to provide a partially stabilized zirconia.

BRIEF DESCRIPTION OF THE DRAWINGS

The accompanying drawings illustrate embodiments of the present invention.

FIGS. 1 to 3 illustrate a first embodiment of the present invention.

FIG. 1 is a plan view showing an auxiliary nozzle in the first embodiment of the present invention; FIG. 3 is a longitudinal sectional view.

FIG. 4 is a longitudinal sectional view; and FIG. 5 is a sectional view taken along line V—V of FIG. 4.

FIG. 6 is a longitudinal sectional view of an auxiliary nozzle 30; FIG. 7 is a sectional view similar to FIG. 5; FIG. 8 is an explanatory view of the discharge process for a jet orifice; and FIG. 9 shows an auxiliary nozzle by which a weft is fed into a warp.

DESCRIPTION OF THE PREFERRED EMBODIMENTS

Figure 1:
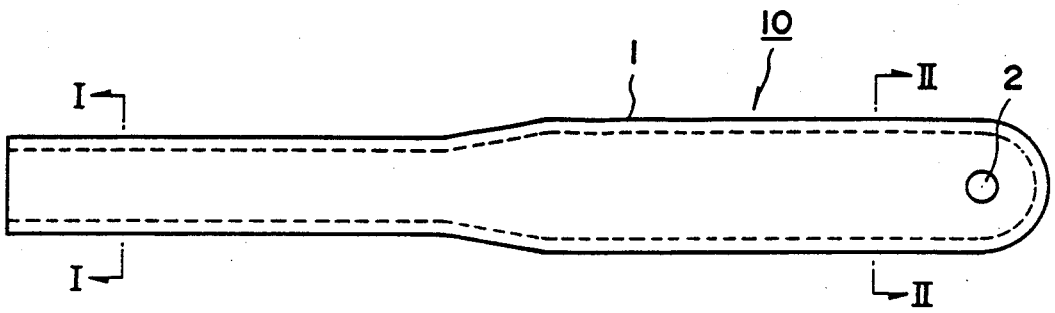

The partially stabilized zirconia ceramics or zirconia used comprises, for example, zirconia partially stabilized by yttrium oxide of 2–5 mol. %.

For example, as described in Japanese Unexamined Patent Publication (Kokai) No. 103078/1985, partially stabilized zirconia is obtained by stabilizing fine powder of zirconium oxide with a stabilizer of 2–6 (mol %) such as yttrium oxide, and adding thereto a powder of 40 (capacity %) such as titanium carbide, tungsten carbide or the like as an agent for applying conductivity, followed by sintering to provide a conductive ceramics which is excellent in wear resistance at least on the surface of the auxiliary nozzle as compared with metal and cermet. At the same time, electric discharge machining of the auxiliary nozzle body becomes possible.

As the above-described ceramics material, a ceramics material having a high toughness and high strength which comprises ultrafine grains can be used to obtain an auxiliary nozzle having a surface roughness of 0.5 μm or less by electric discharge machining.

The characteristics required for formation of a partially stabilized zirconia sintered body from the aforesaid starting powder material are sinterability at low temperature, ultrafine powder properties, small grain-growth rate during sintering and the like. As a material powder which fulfills these conditions, a material produced by a chemically neutral coprecipitation process [Japanese Patent Publication (Kokoku) No. 39367/1984], a hydrolysis process [Japanese Patent Publication (Kokoku) No. 39366/1984] or other processes, and zirconium oxide obtained by adding yttrium salt in an amount of approximately 3 (mol %) in conversion of oxide to water soluble zirconium salt can be used as starting material. The partially stabilized zirconia ceramics as a sintered body has a high strength and high toughness and is optimum as a mechanical structural material.

In place of the partially stabilized zirconia, various materials such as, in addition to alumina, zirconia-alumina, silicon carbide, silicon nitride and sialon, composite ceramics comprising a composition of more than two kinds selected from oxide, carbide, nitride and boron can be used. This ceramics material is generally excellent in wear resistance as compared with metallic material and cermet. However, in the auxiliary nozzle for uses of the present invention, the characteristics of the ceramics material preferably include a relative density of 98% or more, a hardness in $H_RA$ of 89 or more, a bending strength of 50 kg/mm$^2$ or more, a modulus of elasticity of $1.4\times10^4$ kg/mm$^2$ or more, and a homogeneous structure, more preferably, a relative density of 99% or more, a hardness of $H_RA$ of 89.5 or more, a bending strength of 70 kg/mm$^2$, and a modulus of elasticity of $1.8\times10^4$ kg/mm$^2$ or more.

Those ceramics materials having a hardness in $H_RA$ of less than 98 are insufficient in wear resistance for a tip portion in frictional contact with the yarn and jet orifice, and cannot expect a service life ten times or more that of a stainless steel auxiliary nozzle. Those ceramics materials having a relative density less than 98% are poor in wear resistance and slidability with yarn, and if the bending strength is less than 50 kg/mm$^2$, the nozzle is possibly damaged by repeated stress over a long period of time. The modulus of elasticity should be at least $1.4\times10^4$ kg/mm$^2$ which does not subject the material to plastic deformation in use, as in metal material.

As the molding methods for the auxiliary injection molding method, centrifugal casting method, casting method, rubber press method or a wet type press method for a clay-like kneaded body can be employed. It is suggested that a binder suitable for these molding methods be mixed in advance into the sintering raw material.

Next, as a method for forming a jet orifice in the fore end of an auxiliary nozzle, it is contemplated to bore the orifice by a grinding, supersonic, or discharge process, or the like, after the nozzle body has been sintered. However, a method for drilling an orifice in a green molded body formed into a predetermined shape in terms of processing efficiency and smoothness of an inner surface of the orifice can be employed. The green molded body is sintered at a temperature corresponding to the properties of the ceramics material used.

The average structural crystal grain of the auxiliary nozzle is 3 μm or less, which need be a dense sintered body. Therefore, it is preferred to sinter by the HIP method.

In the auxiliary nozzle of the present invention, the tip portion of the nozzle body formed from integrally molded ceramics is converged, a jet orifice is formed in an even wall-thickness article formed flatly to a base end, or one surface of the flat portion is made thick and is formed with a jet orifice communicating with the exterior from an internal space.

The sintered body for the auxiliary nozzle, according to the present invention, comprises at least a nozzle tip formed from a ceramics sintered body having a homogeneous structure. In the manufacture of an auxiliary nozzle provided with an opening for jetting high pressure air in a plane portion in the vicinity of the tip portion, the nozzle is obtained by sintering so that the ceramics sintered body has a relative density of 98% or more after a jet orifice has been formed in the green molded body.

For a conductive ceramics material, a jet orifice can be made by use of a drill in the green molded body or by electric discharge machining after completion of sintering.

The following effects can be obtained by the present invention.

The auxiliary nozzle of the present invention is rich in durability and exhibits a stable performance for a long period of time since the ceramics have high hardness, high toughness, stable heat shock and a stable coefficient of thermal expansion.

Since the nozzle is excellent in wear resistance and formed from fine grains, the surface thereof is smooth, and even if the surface comes into frictional contact with the warp, no partial wear occurs, and further, even if wear progresses, a lapping-like surface is always maintained and even during movement into and out of the warps, frictional resistance is small and thus partial wear is small.

Since the surface is smooth, less surface peeling occurs and the smoothness of the surface can be maintained for a long period of time when compared with nozzles formed by surface coating of a hard metal having a high hardness to a base material.

As to shape, at least those portions other than portions determining a length of a jet orifice can be formed thin in wall thickness, and therefore, the volume can be increased without increasing the outside diameter dimension to thereby enhance the rate of jet flow, or the outside diameter dimension can be made small without decreasing the volume to thereby suppress any influence on the warp.

Since the tip portion can be prepared to be flatter, the tip portion of the nozzle can easily enter between the warps. In addition, when the tip portion is moved in and between the warps, no great bending occurs in the warp and the tension of the warp is not temporarily increased, and therefore warp damage or warp breakage can be prevented.

Furthermore, the wall thickness of a portion in the periphery of the jet orifice can be suitably adjusted to easily secure a required jet flow angle. It is possible to obtain a complicated auxiliary nozzle shape which is thin and has an enlarged tip portion.

Moreover, since the auxiliary nozzle of the present invention is manufactured by a powder metallurgy process, it has a homogeneous structure and excellent wear resistance, thus preventing catching in the warp and warp fluffing.

Other features of the present invention will become more apparent from the ensuing description of the embodiments.

When the surface of the auxiliary nozzle is formed of conductive ceramics, electric discharge machining of the jet orifice becomes possible, burrs and sharp edges disappear after being processed, and thereafter the jet flow becomes stabilized.

When the whole auxiliary nozzle has conductivity, even if the auxiliary nozzle or warp is charged with static electricity by frictional sliding between the auxiliary nozzle and the warp, unexpected trouble resulting from the charge of static electricity can be prevented because the conductivity dissipates the static electricity.

When a jet orifice is bored in a green molded body, drilling work becomes easier, and the shape characteristic of the jet orifice itself is excellent. Particularly, the jet orifice itself bored with an orifice has a surface roughness of 0.5 μm or less. Accordingly, high pressure air jetted out of the jet orifice will not produce turbulence, and therefore, a high-speed air flow of 1.2 times or more compared with a metal nozzle is obtained. Since the high pressure air is jetted at an accurate jet flow angle, the weft can be accelerated, and the number of nozzles to be mounted can be reduced to approximately ⅔.

Since the specific gravity of the nozzle body can be decreased as compared with that of cermet or the like, reduction in weight of members relevant to the beating up operation is effectively attained.

FIRST EMBODIMENT

Figure 2A:
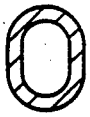
FIGS. 2*a* and 2*b* are sectional views taken along line I—I and line II—II, respectively, of FIG. 1.
Figure 2B:
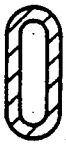
Figure 3:
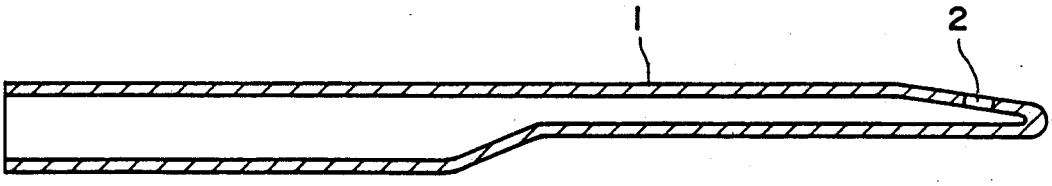

Referring to FIGS. 1 to 3, in an auxiliary nozzle 10, a body 1 is formed at the fore end with a jet orifice 2 for jetting pressurized gas. A wall thickness of the body 1 is approximately 0.2 to 0.5 mm though it is slightly different depending on the pressure of fluid used.

It has a flat fore end, as shown in FIG. 2*b*, extending from a base end having close to a circular shape, as shown in FIG. 2*a*.

In the manufacture of an auxiliary nozzle as a thin hollow article, the nozzle is molded by a molding method using, as a material, a zirconia slurry partly stablizied by yttria, a jet orifice is bored by a cemented carbide drill or a diamond drill in the green molded body, and thereafter the bored green molded body is sintered for 2 hours at a temperature of 1450° C. in an atmospheric furnace. A test piece prepared under the same conditions as those used in the above-described process has a specific gravity of 6.0, a hardness $H_RA$ of 89.8, a modulus of elasticity of $1.55\times10^4$ kg/mm$^2$, and a bending strength of 125 kg/mm$^2$.

The thus obtained auxiliary nozzle has excellent strength, with a bending strength of 120 kg/mm$^2$ or more, a flat portion with a surface roughness after lapping finish of 0.1 μm or less, and an inner surface of the jet orifice having a smooth surface with a surface roughness of 0.5 μm or less. A plurality of auxiliary nozzles d as mentioned above are arranged widthwise of warp a as shown in FIG. 9, and air is jetted out of a jet orifice 2 under pressure of 1 to 4 kg/cm$^2$ to accelerate a weft c. Even after use for 3,000 hours under the aforementioned conditions, weft c is able to be inserted in a stable manner without adverse affect on the warp a. Although the auxiliary nozzle d is sometimes somewhat worn due to frictional contact between it and the warp a, the surface afte having been worn always maintains its smooth surface without producing a flaw or crack in the surface of nozzle body b, unlike the prior art metal auxiliary nozzle.

Moreover, the aforementioned test piece sintered at 1450° C. and the auxiliary nozzle d were subjected to HIP treatment under the conditions of temperature of 1,000° to 1,500° C. and pressure of 1,000 kg/mm$^2$ or more in an atmosphere of inert gas (Ar), the specific gravity was 6.05, hardness $H_RA$ was 91.3, and the performance of the auxiliary nozzle was further improved.

SECOND EMBODIMENT

Figure 4:
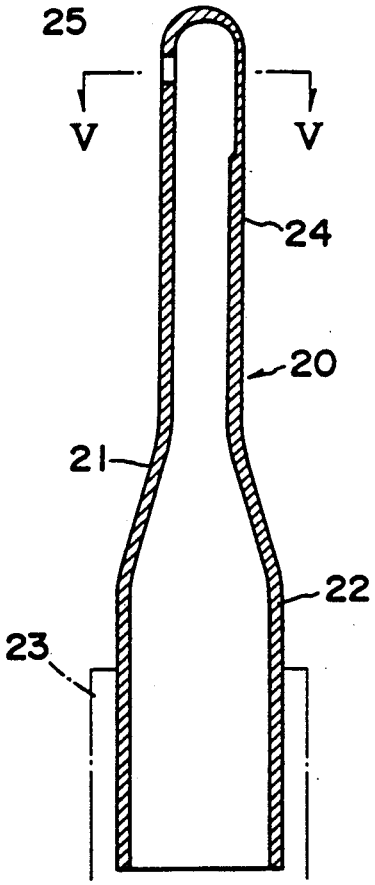
FIGS. 4 and 5 illustrate a second embodiment of the present invention.

A nozzle body 21 (indicated by hatched lines) of an auxiliary nozzle 20, as shown in FIG. 4, is formed of zirconia fine powder of high purity, to which is added 3 mol % of yttrium oxide as a stabilizer, simultaneously followed by stabilization and sintering to provide an integral structure.

Figure 5:
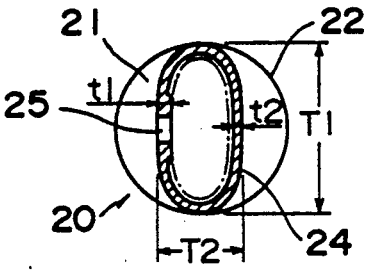

A base end 22 of the nozzle body 21 is an open true cylinder so that it may be connected to a pressurized air source through a holder 23; the nozzle body 21 having a tip portion 24 formed of the same material and closed in the form of a covergent shape, and a portion from the tip 24 to the base end 22 is formed into a flat form. Therefore, a cross-sectional shape of the tip portion 24 is oval or elliptical as can be seen in FIG. 5. One flat surface of the tip portion 24 has a thick wall while the other surface is formed to be thinner than the thick wall. As a result, the internal volume of the flat portion can be increased in volume as much as possible by making the wall thereof thin. FIG. 5 shows an example in which the tip portion is made thin by scraping off an inner portion of an oval or elliptical portion.

The thick portion is formed in the substantially central position of the tip portion with a jet orifice 25 in a direction, for example, at a right angle to the flat surface. Since the jet orifice 25 extends through the thick portion from the internal space to the exterior, the length thereof or the depth of the orifice has a necessary and sufficient dimension in connection with the diameter thereof in order to orient the jet fluid therein with respect to the exterior in a stable state and jet in a state with the least turbulence. This orifice can be formed by drilling in the green molded body, by a supersonic vibration machining process after sintering, by use of a diamond drill process, or when carbide or the like as a conductive material is mixed into fine powder as a raw material, by electric discharge machining.

For the purpose of comparison, a sub-nozzle having the same configuration as that of a conventional metal sub-nozzle and a sub-nozzle having the same internal volume as that of the prior art where prepared in trial according to the present invention.

As shown in FIG. 5, let $T_1$, $T_2$, $t_1$ and $t_2$ be the dimensions of the parts. The dimensions of the prior art sub-nozzle are as indicated below:

$T_1=4.5$ (mm)

$T_2=2.5$ (mm)

$t_1=0.5$ (mm)

$t_2=0.5$(mm)

An article manufactured according to the present invention is molded with dimensions noted below:

$T_1=4.5$ (mm)

$T_2=2.5$ (mm)

$t_1=0.5$ (mm)

$t_2=0.2$ (mm)

From the above dimensions and according to calculation, in the article of the present invention, the internal volume in the vicinity of the jet orifice has been increased by 52% without hardly changing the external dimension.

THIRD EMBODIMENT

Figure 6:
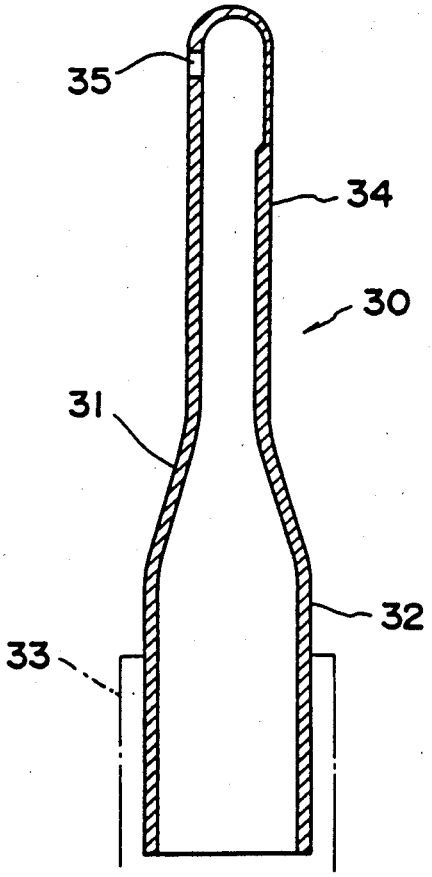
FIGS. 6 to 8 illustrate a third embodiment.

A nozzle body 31 (indicated by hatched lines) forming an auxiliary nozzle 30 for a fluid jet type loom according to the present invention, as shown in FIG. 6, is formed of conductive zirconia type ceramic. In this conductive zirconia type ceramic, yttrium oxide in the quantity of approximately 3 mol % is added as a stabilizer to zirconia fine powder of high purity, and a carbide such as titanium carbide, tungsten carbide or the like in the amount of 17–40 volume % is added as an agent for applying conductivity to the aforesaid mixture, which is molded, simultaneously followed by stabilization and sintering to provide an integral structure.

Figure 7:
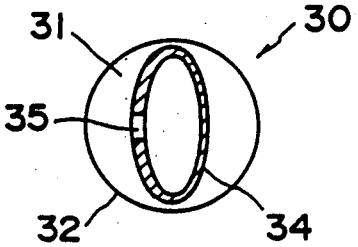
Figure 8:
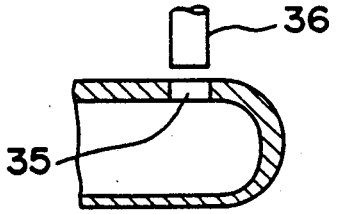

A base end 32 of the nozzle body 31 is an open round cylinder so that the former may be connected to a pressure air source through a holder 33, the nozzle body 31 having a tip portion 34 closed in the form of a convergent shape, and a portion from the tip to the base end is molded into a flat shape. To this end, a section of the tip portion 34 is of an elliptical shape, as can be seen in FIG. 7. Moreover, one flat surface of the tip portion 34 is thick whereas the other surface is molded to be thinner than the thick surface. As a result, the internal volume of the flat portion is increased in volume as much as possible by making it thin. The thick portion of the tip portion 34 is formed with a jet orifice 35 in a direction, for example, at a right angle to the flat surface in a substantially central position on the side of the tip. The jet orifice 35 is bored in the green molded body or processed by electric discharge machining shown in FIG. 8, after having been sintered. In the discharge processing, the nozzle body 31 is positioned in a state wherein the body 31 is made to correspond to one electrode of the electric discharge machining and the other electrode 36 is moved close to a processing position of the jet orifice 35. In this state, a discharge voltage is applied between one electrode 36 and the nozzle body 31 as the other electrode to form the jet orifice 35, and the inner and outer open surfaces of the jet orifice 35 are formed to have a surface which is free from burrs, has an adequate curved surface and is smooth.

As compared with other conductive ceramics, the conductive zirconia ceramic in the present embodiment is high in toughness, rich in durability and can provide a stable performance for a long period of time without change over the passage of years, and the auxiliary nozzle can be formed into a flat configuration without impairing the mechanical strength.

We claim:

1. An auxiliary nozzle adapted for use with a fluid jet-type loom, comprising a hollow nozzle body having an inner surface, said hollow nozzle body including a tip portion formed of integrally-molded ceramics material, said ceramics material having a superfine grain size, high toughness and high strength, said nozzle body further including a jet orifice in said tip portion for jetting pressurized gas from inside said nozzle body to an exterior of said nozzle body, said jet orifice having an inner surface, the inner surface of said nozzle body and said jet orifice having a surface roughness of 0.5 μm or less.

2. An auxiliary nozzle according to claim 1, wherein said ceramics material comprises zirconia-type ceramics.

3. An auxiliary nozzle according to claim 2, wherein said zirconia-type ceramics comprises partially-stabilized zirconia ceramics.

4. An auxiliary nozzle according to claim 3, wherein said partially-stabilized zirconia ceramics further comprises an electrically conductive agent.

5. An auxiliary nozzle adapted for use with a fluid jet-type loom, comprising a wall defining a hollow nozzle body, said hollow nozzle body including a tip portion formed of integrally-molded ceramics material, said ceramics material having a superfine grain size, high toughness and high strength, said hollow nozzle body further including a jet orifice in said tip portion for jetting pressurized gas from inside said nozzle body to an exterior of said nozzle body, said wall defining said hollow nozzle body having an even wall thickness of 0.2 to 0.5 mm.

6. An auxiliary nozzle according to claim 5, wherein said ceramics material comprises zirconia-type ceramics.

7. An auxiliary nozzle according to claim 6, wherein said zirconia-type ceramics comprises partially-stabilized zirconia ceramics.

8. An auxiliary nozzle according to claim 7, wherein said partially-stabilized zirconia ceramics further comprises an electrically conductive agent.

9. An auxiliary nozzle adapted for use with a fluid jet-type loom, comprising a hollow nozzle body, said hollow nozzle body comprising a hollow rear end portion converging into a flat hollow front end portion, said hollow nozzle body being formed of integrally-molded ceramics material having a superfine grain size, high toughness and high strength, said flat hollow front end portion including a first relatively-thick wall and a second relatively-thin wall opposite said first wall, and a jet orifice formed in said relatively-thick wall for jetting pressurized gas from inside said nozzle body to an exterior of said nozzle body.

10. An auxiliary nozzle according to claim 9, wherein said ceramics material comprises zirconia-type ceramics.

11. An auxiliary nozzle according to claim 10, wherein said zirconia-type ceramics comprises partially-stabilized zirconia ceramics.

12. An auxiliary nozzle according to claim 11, wherein said partially-stabilized zirconia ceramics further comprises an electrically conductive agent.

13. An auxiliary nozzle adapted for use with a fluid jet-type loom, comprising a hollow nozzle body, said hollow nozzle body including a tip portion formed of integrally-molded ceramics material, said ceramics material having a superfine grain size, high toughness and high strength, and a jet orifice in said tip portion for jetting pressurized gas from inside said nozzle body to an exterior of said nozzle body, wherein said integrally-molded ceramics material has a relative density of at least 98%, and $H_RA$ hardness of at least 89, a bending strength of at least 50 kg/mm, a modulus of elasticity of at least $1.4\times10^4$ kg/mm$^2$ and a homogeneous structure.

14. An auxiliary nozzle according to claim 13, wherein said integrally-molded ceramics material comprises zirconia, said zirconia comprising partially-stabilized zirconia.

15. An auxiliary nozzle adapted for use with a fluid jet-type loom comprising a hollow nozzle body, said hollow nozzle body including a tip portion formed of integrally-molded ceramics material, said ceramics material having a superfine grain size, high toughness and high strength, and a jet orifice in said tip portion for jetting pressurized gas from inside said nozzle body to an exterior of said nozzle body, wherein said integrally-molded ceramics material has an average structural crystal grain size of 3 μm or less.

16. An auxiliary nozzle according to claim 15, wherein said integrally-molded ceramics material comprises zirconia, said zirconia comprising partially-stabilized zirconia.

* * * * *